US006126202A

United States Patent [19]

Scocca

[11] Patent Number: 6,126,202

[45] Date of Patent: Oct. 3, 2000

[54] BOOK PUBLISHING KIT FOR CHILDREN

[76] Inventor: James R. Scocca, 33-22 164th St., New York, N.Y. 11358

[21] Appl. No.: 09/219,406

[22] Filed: Dec. 23, 1998

[51] Int. Cl.[7] ..... B42D 15/00

[52] U.S. Cl. ..... 283/45; 281/2; 281/5; 283/62; 283/67; 283/117

[58] Field of Search ..... 281/2, 5; 283/45, 283/62, 67, 117

[56] References Cited

U.S. PATENT DOCUMENTS 1,781,047 11/1930 Bondeson ..... 283/45
5,397,156 3/1995 Schach et al. ..... 283/117

*Primary Examiner*—Willmon Fridie, Jr.
*Assistant Examiner*—Mark T. Henderson
*Attorney, Agent, or Firm*—Richard B. Klar

[57] ABSTRACT

The invention relate to a book publishing kit for children the kit includes two templates and a number of sheets. The sheets include a cover on which a cover template is placed with a cut out preferably rectangular area in which a drawing can be made. Sheets are provided for internal book pages and another template is placed on each of these pages with a cut out preferably rectangular opening of a different sizing and centering with respect to the page than that of the cover sheet for illustration purposes. The bottom of each page is reserved for printing text of up to fifteen words in length. Separate sheets are provided with boxes in which text for the pages can be written and the page number indicated within a smaller box of each respective text box.

The sheets are sent to the publisher in a self addressed envelope with the order form filled out indicating whether the child's spelling should be corrected. The kit includes washable markers for the illustrations.

11 Claims, 7 Drawing Sheets

HOME PUBLISHER INSTRUCTION SHEET

Thank you for purchasing the HOME PUBLISHER™ Your kit should include the following: 1-Home Publisher Page Tumplate; 1-Cover Drawing Template; 14-Home Publisher Pages; 3-Home Publisher Text Pages (yellow); 2-"Your Cover Drawing Pages"; 1-Set Washable Markers; 1-Mailing Envelope; 1-Instruction Sheet; 1-Order Form; 2-Paper Clips; 1-Visual Sheet.

Writing your Book Pages

- Tell your story (in English Only) in the boxes provided on the yellow pages. Do not write more than 15 words per box without exceeding 12 boxes (one box of text for each page). Writing in pencil will make it easier in case you make mistakes.
- Make sure to write your Page number in each HOME PUBLISHER™ page box.
- Do all of your drawing for each page using the HOME PUBLISHER™ Page TEMPLATE. Use only the markers provided with your kit and do not paste anything onto the pages until you have received the completed book back from us.(no photocopies).

Making Your Cover Drawing Page

- To make your cover drawing Use Your Cover Drawing Template, place it over the cover drawing page and follow instructions on template (using only markers provided with your kit).
- You may enter the information for your Cover Drawing Page on the bottom of only one of your yellow sheets in the space designated Cover Drawing Page. This information can include the Story Title, the Author (by), and the person(s) to whom you are giving the book.

Sending it to us

- Return your completed forms (Home Publisher Pages, Home Publisher Text Pages, and your Home Publisher Order Form) in pre-addressed envelope to BEYOND GRAPHICS INC.,20-04 UTOPIA PARKWAY, SUITE 283, WHITESTONE, NY, 11357.
- Beyond Graphic Inc. will return your book in about 4 to 6 weeks from the time we receive it.
- The postage paid envelope in the kit can only be used within the United States.
- Be sure that your template aligns with the drawing page underneath at all times while you are drawing, otherwise your drawing may not fit on the page properly for printing. Use the included paper clips to keep pages from shifting. Keep all pages clean, flat, and dry (they will be bound into your book) and use only the markers included with your kit.

HOME PUBLISHER

10

FIG. 1

BOOK PUBLISHING KIT FOR CHILDREN

BACKGROUND OF THE INVENTION

1. Field of the Invention

The present invention relates to a book publishing kit for children. In particular the present invention relates to a book publishing kit that is easy to utilize, and ship back for binding. The kit provides templates which facilitates the fun in preparing the illustrations and safeguarding that the drawings for the cover sheet and the sheet of the book pages are drawn in the proper places and not in the area for the text.

Further the kit provided a separate pages for recording text for each book page in the appropriate boxes which are marked with the correct page number for reprinting on the page where the corresponding illustration is drawn.

2. The Prior Art

A book publishing kit is sold by a Denver Colorado company called Chimeric, Inc under the trademark ILLUSTORY®. This kit provides pages on which a portion of the page is framed for drawings and a bottom portion of the same page is provided for text. The book is sent back for binding. a cover sheet for illustration is also provided.

It would be desirable to provide a simpler, more efficient kit and one which provides more fun for a child to prepare in which templates are provided on the sheets where illustrations are drawn and text is written separately in the appropriate boxes of a sheet to be later printed onto the illustrated sheets do that the illustrated sheets are not effected by erasures or mistakes by the child's written text.

SUMMARY OF THE INVENTION

It would be a principle object of the invention to provide a book publishing kit for children that is easy and fun to use and ship back.

It is another object of the invention to provide a book publishing kit that provides a template for designating the place for locating the cover sheet drawing and another template for designating the drawings for each page of the book so that the drawings stay within bounds on the particular sheet and are centered with respect to the respective page and prevents stray drawing markings from appearing on portions of the pages designated for text.

It is yet another object of the invention to provide one or more pages with boxes where each box is designated for text for a specific page of the book whose page is to be indicated in the box.

Further it is another object of the invention to provide a pre-addressed envelope to send the pages of the book kit to the publisher for binding and printing.

Further objects will become more readily apparent in the description and drawings provided.

BRIEF DESCRIPTION OF THE DRAWINGS

FIG. 1 is an instruction sheet of the book publishing kit of the present invention;

DETAILED DESCRIPTION OF THE PREFERRED EMBODIMENT

Figure 2:
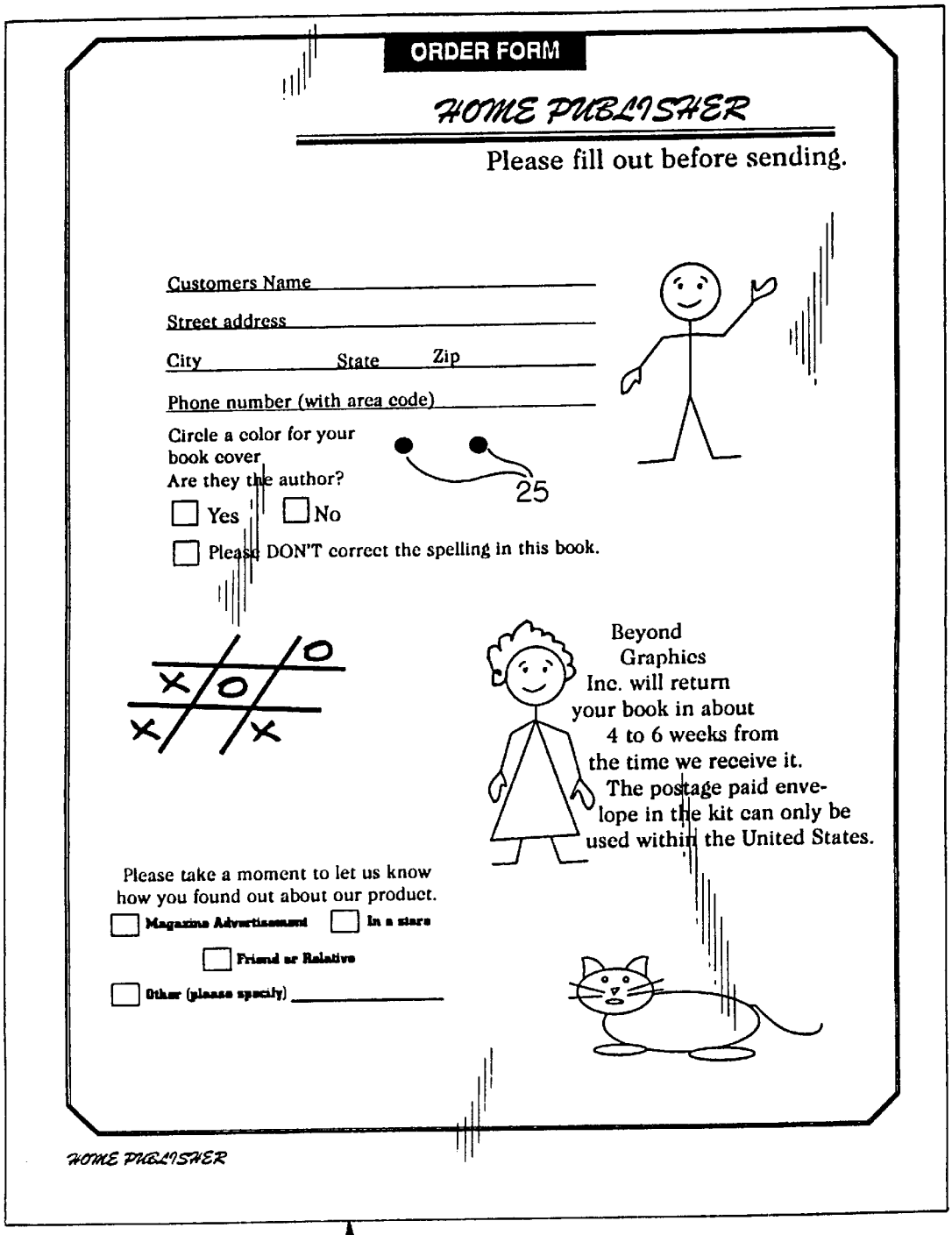
FIG. 2 is an order form for the book publishing kit of the present invention.
Figure 3:
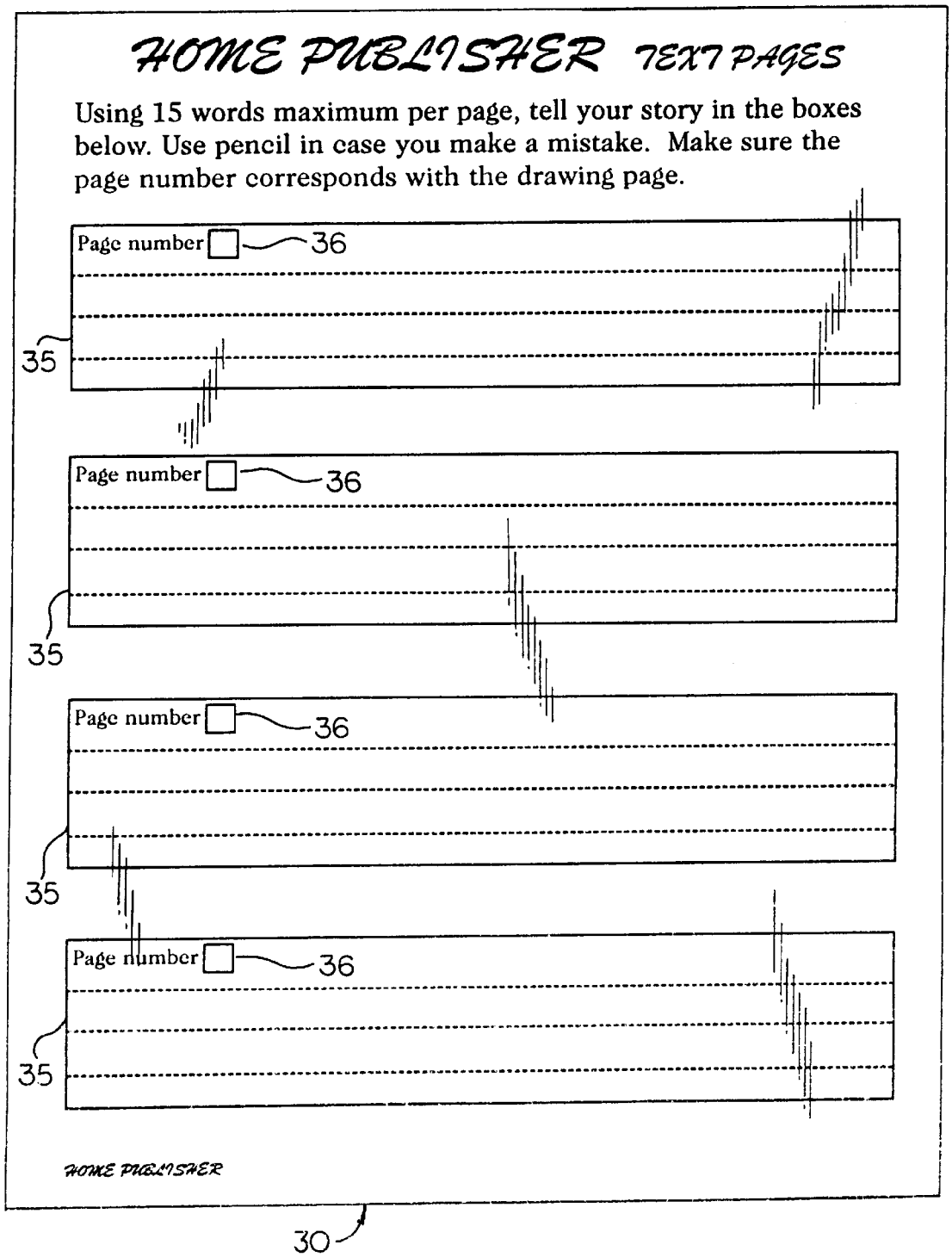
FIG. 3 is a text page sheet having boxes in which text of up to 15 words can be placed for reprinting on the page sheet of the book and a smaller box within each box for indicating the page number of a book formed by the book kit of the present invention.
Figure 4:
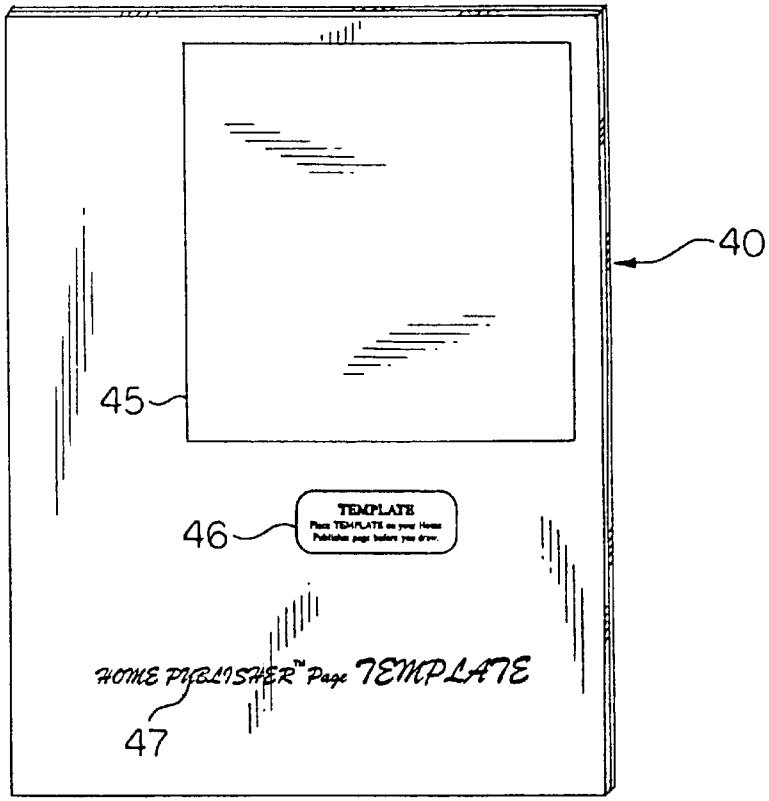
FIG. 4 is an illustration of the template for the page sheets of a book formed by the book kit of the present invention.
Figure 5:
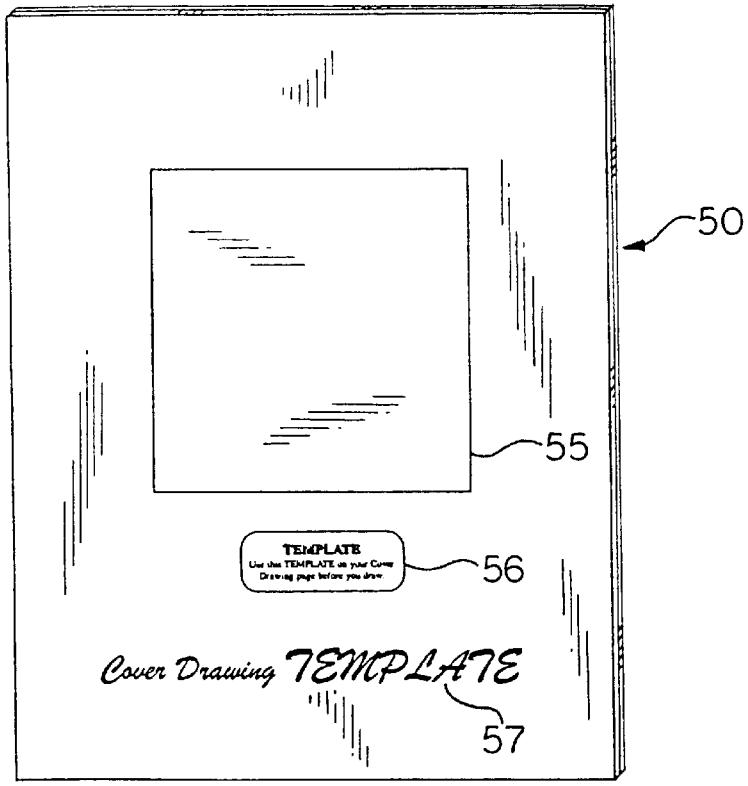
FIG. 5 is an illustration of the template for the cover sheet of a book formed by the book kit of the present invention.
Figure 6:
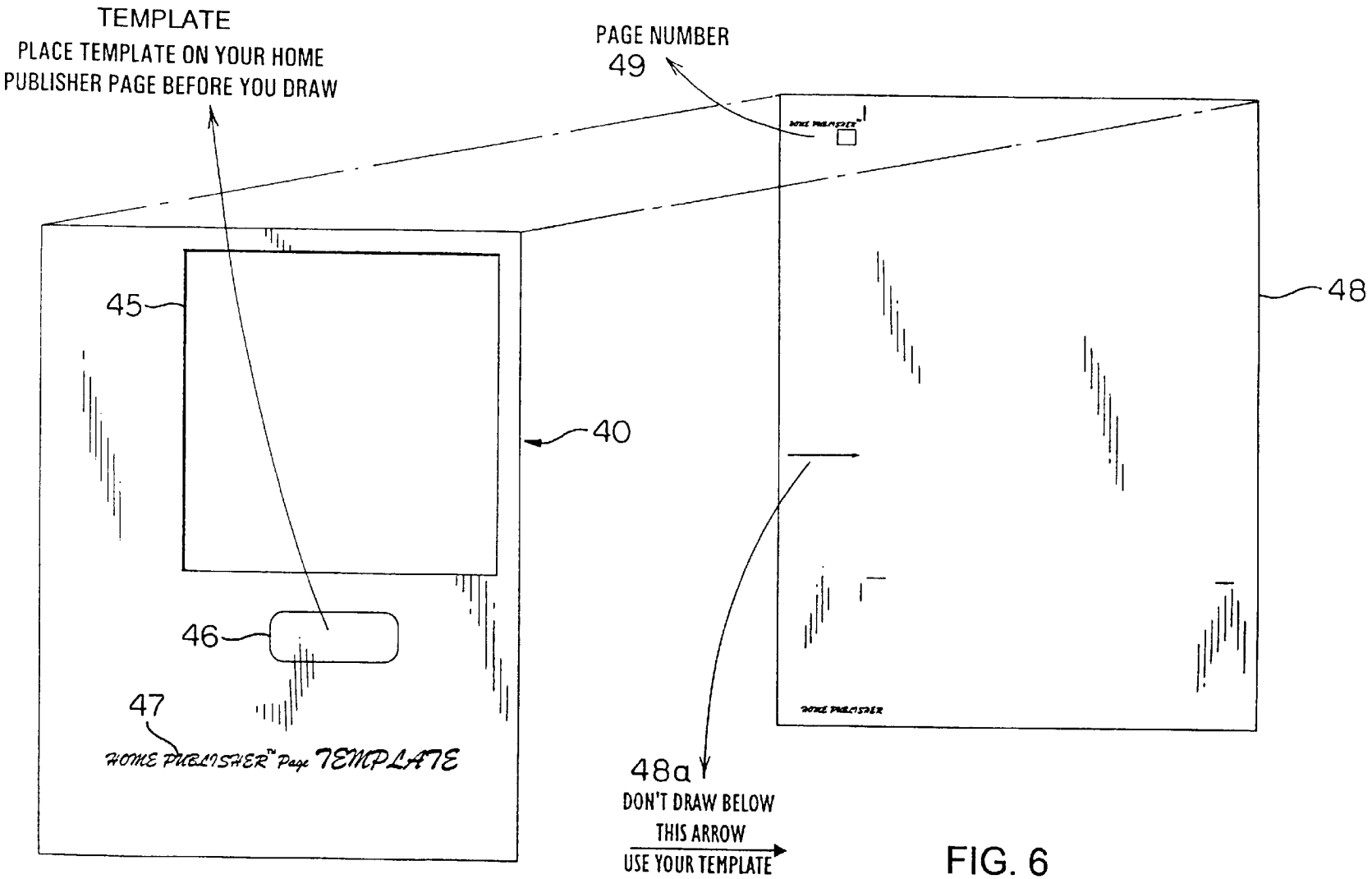
FIG. 6 is an illustration of how the template of FIG. 4 is placed on the page before drawing an illustration.
Figure 7:
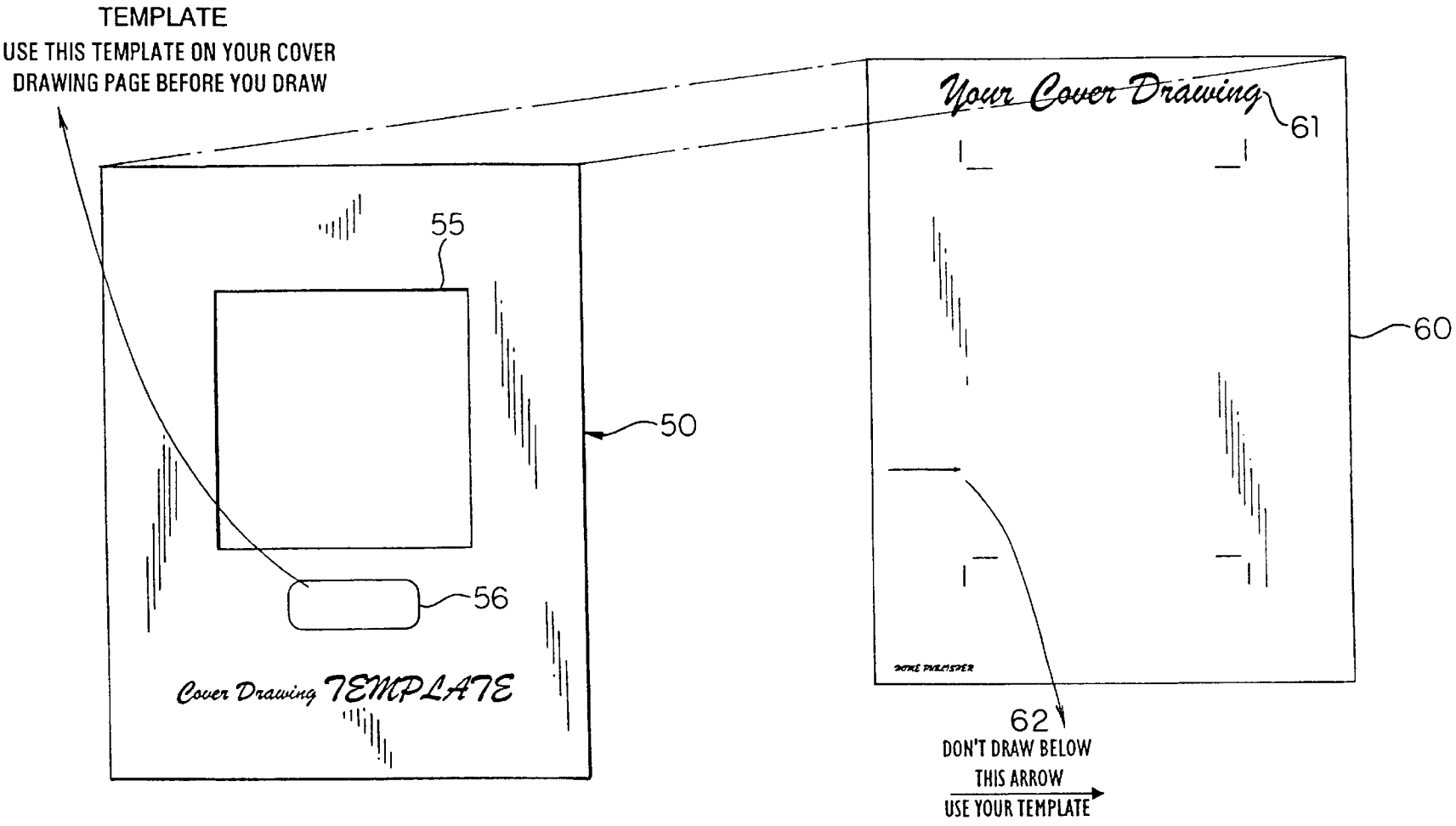
FIG. 7 is an illustration of how the template of FIG. 5 is placed on the cover sheet before drawing an illustration.
Figure 8:
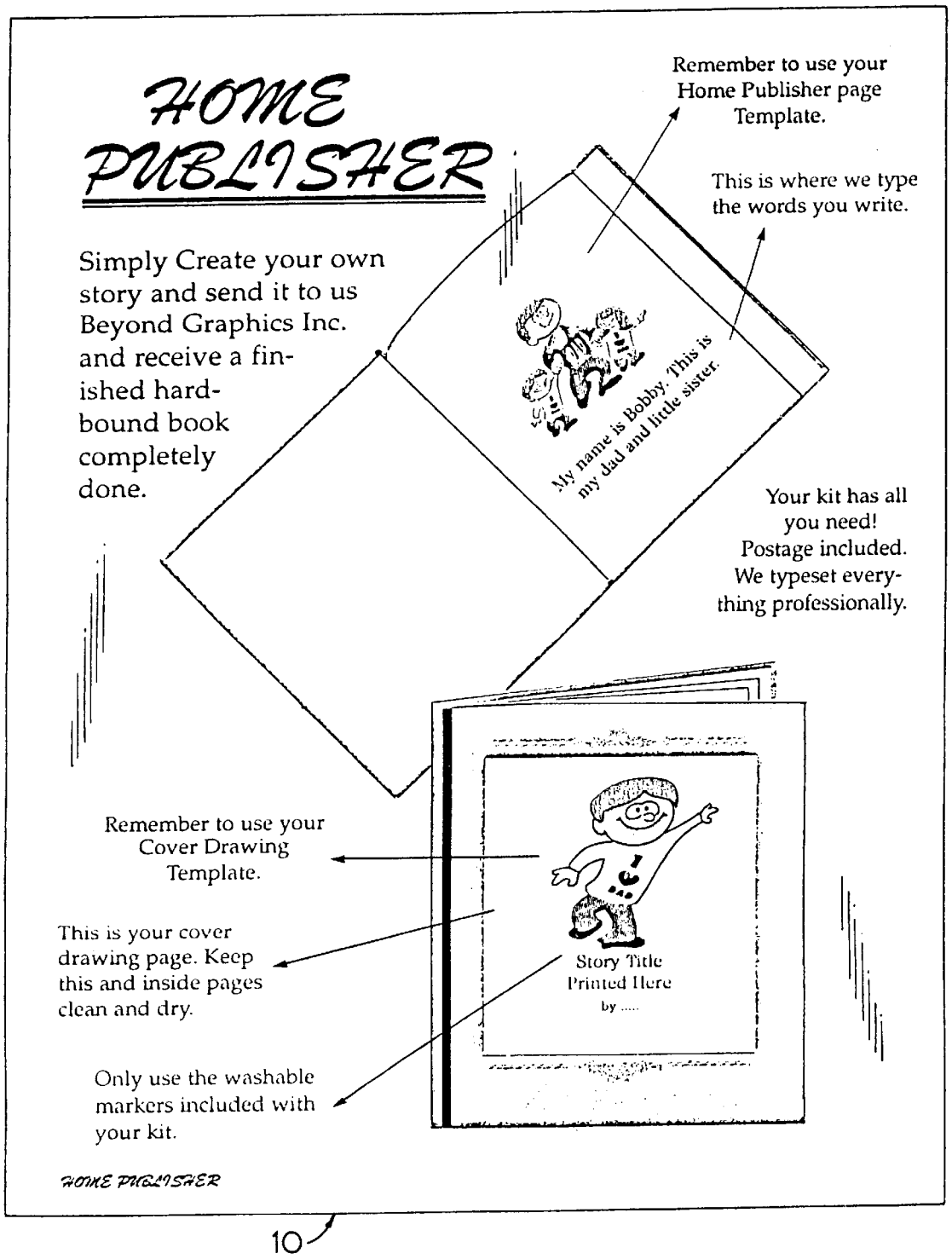
FIG. 8 is an illustrative sheet showing how the book is to be assembled.

Referring now to the drawings of FIGS. 1–8, FIG. 1 is an illustration of the instruction sheet 10 in which the contents of the invention the book publishing kit is listed. The contents of the invention include: a template 40 for the pages of the book as shown in FIG. 4; a template 50 for the cover sheet of the book as shown in FIG. 5; text pages 30 as shown in FIG. 3, preferably three and preferably on yellow paper, for writing the text for each page. two cover drawing sheets or pages 60 with the extra cover sheet provided for mistakes or changes; sheets for the book pages 48; one set of washable markers; an order form 20; an illustration or visual sheet 70 which provides information and instruction to the user on how the book will be bound and published as shown in FIG. 8; and two paper clips to be fastened with the cover sheet template 50 when aligned with the cover sheet to ensure it is in place before drawing on the cover sheet 60 and also the paper clips are to be affixed when the aligned page sheet 48 and the template of the book page sheet 40 before drawing on the page sheet 48.

FIG. 2 is an illustration of the order form 20 which indicates that the user should indicate if spelling of the text should be corrected and the cover for the book cover which is indicated by preferably two differently colored dots 25 such as a red dot or a blue dot.

FIG. 3 is one of preferably three text page forms 30. Each page includes four boxes 35 for placing text therein and a smaller box 36 indicating the page of the book on which that text is to appear. The text should be limited to fifteen words as indicted on this page.

FIG. 4 is the page 40 template preferably made of cardboard material such as bristol board with a cut out section 45 preferably of rectangular shape. The page template includes the legend 46 printed thereon to "Place TEMPLATE on your Home Publisher page before you draw." In addition the words Home Publisher Page TEMPLATE at the bottom 47 of the page template. Preferred dimensions for the page template are 8½" by 11" with the cut out section 45 having the preferred dimensions of 5½" by 5¾".

FIG. 5 is the cover drawing or cover sheet template 50 preferably made of cardboard material such as bristol board with a cut out section 55 preferably of rectangular shape. The cover drawing template includes the legend 56 printed thereon to "Place TEMPLATE on your Cover Drawing before you draw." In addition the words Cover Drawing TEMPLATE are at the bottom 57 of the page template. Preferred dimensions for the page template are 8½" by 11" with the cut out section 55 having the preferred dimensions of 4½" by 5".

FIG. 6 is an illustration of how the page template 40 is placed over one of the several sheets 48 of book pages provided by the kit. As can be seen the book page 48 has in its upper left hand corner a small box in which the page number 49 can be written so that the text from the appropriate box of the text page form 30, FIG. 3 can be matched by the publisher for placing the text with the correct page of illustration for the book and also to place the pages in the correct order for the book before binding the book. Also on the page sheet 48 there is an arrow with text above and below the arrow line 48*a* which reads "Don't Draw Below This Arrow Use Your Template". In FIG. 6 two paper clips provided by the kit but not shown are used to clip the template together with the book page after the template 40 and book page 48 have been aligned. The child then draws within the cut out section 45 of the template 40 without worrying about the washable markers, one set of which is provided by the kit, straying beyond the designated area for the drawing. As can be seen the cut out section 45 of the page template 40 is slightly of to the right upper portion of the template 40 so that the drawings will appear on the upper right side of each book page 48. The area below the arrow 48*a* on each book page 48 is where the text will be reprinted from the corresponding box on the text page form.

Similarly, FIG. 7 is an illustration of how the cover drawing template 50 is placed over the cover drawing page 60 for the book. As can be seen the cover drawing page 60 has text 61 at the top indicating it is the cover drawing book page 60. Also there is an arrow 62 with text above and below the arrow line which reads "Don't Draw Below This Arrow Use Your Templates". In FIG. 7 two paper clips provided by the kit but not shown are used to clip the template 50 together with the cover drawing sheet 60 after the template 50 and book page 60 have been aligned. The child then draws within the cut out section 55 of the template without worrying about the washable markers of various colors straying beyond the designated area for the drawing.

As can be seen the cut out section 55 of the cover drawing template 50 is centered so that the drawings will appear in the center of the cover drawing sheet 60. The area below the arrow 62 on the cover drawing page 60 is where the text will be reprinted from a designated box on the text page form 30 for the cover drawing sheet 60 indicating the title of the book, the author and to whom if anyone the book is being given as a gift.

Once the pages are drawn and the text written in the boxes of the text page the material can be mailed back to the publisher in pre-addressed envelope included with the kit. The publisher will then match the drawings with the text and print and bind the book. The book cover can be one of two colors chosen on the order form 20 by the child. By using templates 40, 50 the preparation of the book pages 48 and cover drawing sheet 60 is easier and more fun for a child. The completed bound book is mailed back to the home of the child within a number of weeks.

I do not limit myself to any particular details of construction set forth in the specification and illustrated in the accompanying drawings, as the same refers to and sets forth only certain embodiments of the invention, and it is observed that the same may be modified without departing from the spirit and scope of the claimed invention.

Having thus described the invention, what is claimed as new and desired to be secured by Letters Patent is as follows:

1. A book publishing kit for children permitting children to provide text and drawings to be forwarded for assembly and publishing as a book, comprising in combination:

a cover sheet having markings therein and a top surface;

a template for said cover sheet adapted to be aligned in place of said markings of said cover sheet as an overlaying leaf on top of said top surface of said cover sheet, said template for said cover sheet having an opening therein in which an illustration for said cover sheet can be drawn;

at least one sheet for a book having markings therein and a top surface;

a template for said at least one sheet for a book adapted to be aligned in place of said markings for said book sheet as an overlaying leaf on top of said top surface of said booksheet and having an opening therein in which an illustration tor said book sheet can be drawn;

a text sheet form providing the text for each page;

an instruction sheet; and means for forwarding said cover sheet, said book sheet and said text sheet form to a publisher to assemble and publish.

2. A book publishing kit according to claim 1 wherein said means for forwarding is a pre-addressed envelope.

3. A book publishing kit according to claim 1 wherein said kit further comprises:

a set of washable markers for drawing illustrations for the cover sheet and said at least one sheet.

4. A book publishing kit according to claim 1 wherein said text sheet form is formatted with boxes in which to insert a page number for text and text to be printed on a page of said book sheet corresponding to said page number so that text matching said corresponding page can be matched and printed with the drawing on said book sheet.

5. A book publishing kit according to claim 1 wherein said cover sheet template is formed of cardboard material.

6. A book publishing kit according to claim 1 wherein said template said at least one sheet is formed of cardboard material.

7. The kit according to claim 1 wherein said cover sheet template has a cut out section defined by borders in which an illustration of a cover drawing is drawn by aligning said cover sheet template with said cover sheet.

8. The kit according to claim 1 wherein said at least one sheet template has a cut out section defined by borders in which an illustration for said template is drawn by aligning said at least one sheet template with said at least one sheet template.

9. The kit according to claim 1 wherein said markings of said template include arrows identifying where a drawing is to be drawn so that said template can be properly positioned and aligned by said markings for drawing an illustration.

10. A book publishing kit according to claim 1 wherein said text sheet form includes information for a publisher to transform text onto a book sheet having a page number indicated on said text sheet form so that a corresponding drawing and text are matched up on a correct book sheet.

11. A book publishing kit for children permitting children to provide text and drawings to be forwarded for assembly and publishing as a book, said booksheet comprising in combination:

a cover sheet having markings therein and a top surface;

at least one sheet for a book having markings therein and a top surface;

at least one template for said cover sheet and said book sheet adapted to be aligned as an overlaying text on top of said top surface of said cover sheet and on top of said top surface of said book sheet in place of said markings of said cover sheet and said template having an opening therein in which an illustration can be drawn;

a text sheet for providing the text for each page;

an instruction sheet; and means for forwarding said cover sheet, said book sheet and said text sheet form to a publisher to assemble and publish.

* * * * *